US006456179B1

(12) United States Patent
Backa et al.

(10) Patent No.: US 6,456,179 B1
(45) Date of Patent: Sep. 24, 2002

(54) TRANSFORMER

(75) Inventors: Johan Backa, Bergen (NO); Karl Engman, Vaasa (FI); Torvald Haldin, Kuni (FI); Esa Virtanen, Vaasa (FI)

(73) Assignee: Merger Recipient ABB Oy, Helsinki (FI)

( * ) Notice: Subject to any disclaimer, the term of this patent is extended or adjusted under 35 U.S.C. 154(b) by 0 days.

(21) Appl. No.: 09/701,783

(22) PCT Filed: Jun. 1, 1999

(86) PCT No.: PCT/FI99/00479

§ 371 (c)(1),
(2), (4) Date: Dec. 22, 2000

(87) PCT Pub. No.: WO99/63555

PCT Pub. Date: Dec. 9, 1999

(30) Foreign Application Priority Data

Jun. 2, 1998 (FI) ..... 981247

(51) Int. Cl.[7] ..... H01F 27/10

(52) U.S. Cl. ..... 336/57; 336/58; 336/90; 336/94

(58) Field of Search ..... 336/90, 94, 55, 336/57, 58

(56) References Cited

U.S. PATENT DOCUMENTS

| | | | |
|---|---|---|---|
| 3,925,592 | A | 12/1975 | Webb |
| 4,196,408 | A | 4/1980 | Link |
| 4,904,972 | A | 2/1990 | Mori et al. |

FOREIGN PATENT DOCUMENTS

| | | |
|---|---|---|
| DE | 3203936 | 8/1983 |
| GB | 1604978 | 12/1981 |
| JP | 57-18306 | 5/1982 |

*Primary Examiner*—Lincoln Donovan
*Assistant Examiner*—Tuyen Nguyen
(74) *Attorney, Agent, or Firm*—Dykema Gossett PLLC

(57) ABSTRACT

A container (2) with an oil immersed core (1) and windings has corrugated walls. Bushing insulators (9,10) have pressure-resistant and water-resistant cable shoes (11). A tank encompasses another container (4) filled with insulating oil (3) and has pressure-resistant cable bushing (13) and connectors for electrical connections of the transformer.

3 Claims, 1 Drawing Sheet

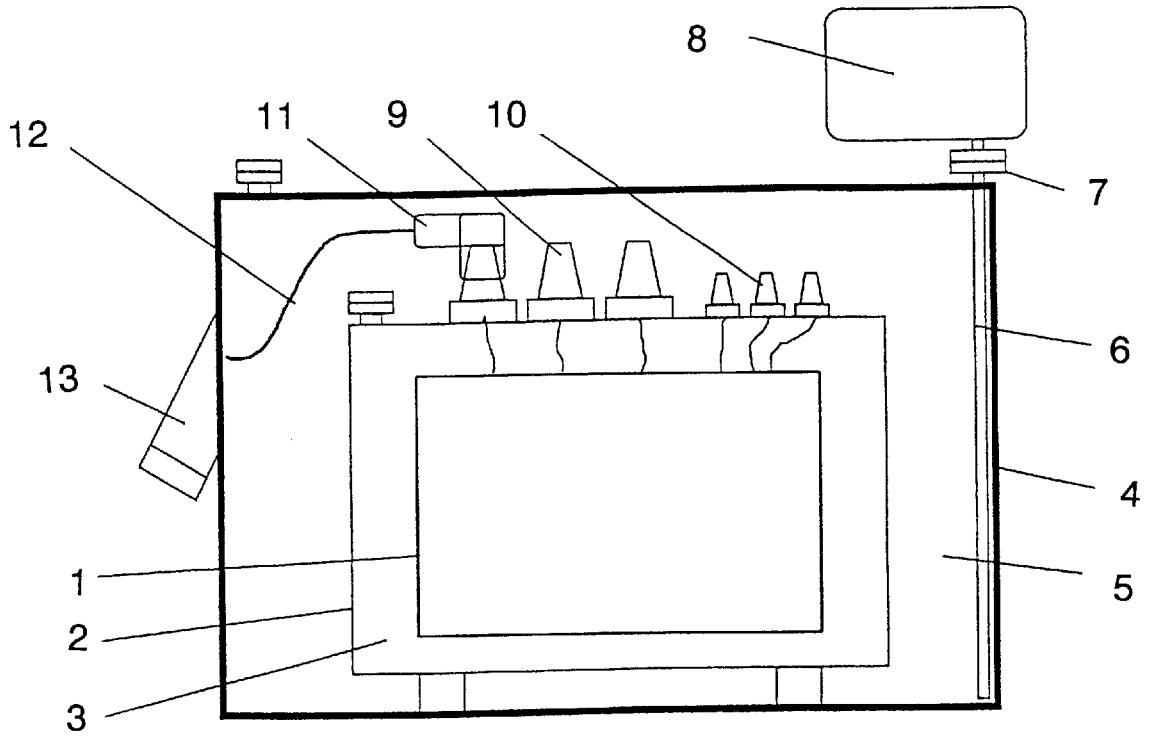
FIG

TRANSFORMER

FIELD OF THE INVENTION

This invention relates to a transformer designed especially for underwater use, which transformer comprises a transformer core and its winding located in a first container filled with an insulating medium, the top surface of which container is provided with pressure-proof bushings for the connecting cables of the transformer, a second container filled with an insulating medium and means for equalising the pressure between the insulating medium in the second container and the transformer surroundings.

When pumping oil or gas, for instance, from the sea bottom, strict operating requirements need to be set on pumping equipment. The electricity supply of the pumps, for instance, is usually arranged by producing the electricity on a rig or a surface vessel from which it is transmitted to the pumps located as far as several kilometres away. To reduce voltage drops in the transmission cable, the voltage is usually raised to a medium voltage and only transformed close to the consumption point to the operating voltage of the motors running the pumps, typically to a level of 1 kV. The structure of such a pump must be such that it is capable of functioning in and enduring conditions at at least 500 m below the surface of the sea.

Prior art uses an oil-filled transformer whose container is made of special steel. Such an underwater transformer is equipped with a pressure equaliser which may slightly leak due to diffusion or malfunction. In such a case, the insulating medium fluid, typically oil, leaks into the sea already causing environmental hazards as such, but the water which has at the same time leaked into the transformer container also weakens the electrical insulation of the transformer and damages the transformer on the long run, in which case electricity supply is interrupted and a sudden pressure increase caused by an electric arc can push all the oil in the transformer into the sea.

British Patent Publication 1 604 978 discloses a solution in which a second oil container with a connection to the pressure equaliser is located below the transformer container. Between the containers, there is a bellows which allows the transformer oil to thermally expand in the first container. This solution provides the advantage that the same pressure exists on both sides of the transformer container, in which case its structure can be made light. In addition, the bellows structure prevents water from leaking into the first container in which it may damage the transformer insulation. In the solution in question, the electrical connection is led directly into the inner container in which the transformer core and its winding is suspended.

Japanese Patent Publication 57 018 306 discloses a double-walled transformer container. A bellows is also used to equalise the pressure between the inner transformer container and the space between the walls, and also to prevent the oil from getting into contact with water.

A particular disadvantage of both above-mentioned solutions is that the electrical inlets must be led directly through to the inner container, whereby their leaks easily become a critical.

BRIEF DESCRIPTION OF THE INVENTION

It is an object of the present invention to introduce a transformer which is better suited than the known transformers to be located at the bottom of the sea. A further object is to produce a transformer construction in which conventional standard-structure distribution transformers can be used as far as possible and to thus achieve low manufacturing costs.

The above-mentioned objects are achieved by means of a transformer of the invention, characterized in that in it a second container is arranged to fully encompass a first container and that the second container is equipped with pressure-proof cable bushings and associated connectors for external electrical connections of the transformer. In the transformer of the invention, the core and windings of the transformer are thus located in the inner container which, in practice, can be a completely standard-structure transformer which is, however, completely encompassed by an outer container also filled with an insulating medium. The pressure-proof bushings preferably arranged in the first container comprise bushing insulators, and the connecting cables of the transformer are connected to these bushing insulators with pressure-proof and water-proof cable shoes. The transformer can be made very reliable by applying this procedure.

According to the invention, the wall of the first container comprises corrugated parts to allow for the volume changes caused by the thermal expansion and pressure changes of the insulating medium filling the first container. Further, it is advantageous that means for equalising the pressure between the insulating medium in the second container and the transformer surroundings comprise a pressure equalising container arranged on top of the second container and a pressure equalising pipe connected thereto, which pipe is led through the second container through a pressure-sealed inlet on its upper surface and arranged to extend to the bottom part of the second container prior to opening into the second container.

It can be noted that the transformer of the invention provides the advantage that the transformer itself can be of standard structure, in which case the wall structure of the first container, i.e. the wall structure of said standard-structure transformer, is corrugated allowing the oil to thermally expand, in which case no separate bellows is needed for this. Further, in the transformer of the invention, a leak in the pressure equaliser does not cause the filling up of the entire outer container with water, since the end of the pipe is led close to the bottom of the outer container. In such a case, a minor leak in the pressure equaliser results in that water goes directly to the bottom part of the outer container and thus does not affect the cable shoes. A leakage water of this kind can only cause a risk with the bushing insulators when the outer container is nearly full of water. Even after this, only a damage in the first, i.e. inner, container or a leak in the watertight cable shoe results in water entry inside the first container and thus damages the insulation of the transformer and causes a disruptive discharge.

BRIEF DESCRIPTION OF THE DRAWING

In the following, the transformer of the invention is described in greater detail with reference to the attached drawing which shows a schematic diagram of the structure of an exemplary embodiment of the transformer of the invention in principle.

DETAILED DESCRIPTION OF THE INVENTION

The figure shows a diagram of an exemplary embodiment of the transformer of the invention. This transformer comprises firstly a standard-structure transformer which has a transformer core 1 with its winding, which is arranged into a container 2 filled with an insulating medium 3. The insulating medium 3 in question is typically an insulating oil and, as already mentioned above, the container 2 is, in practice, the outer housing of a standard-structure transformer, which comprises corrugated parts by means of which the container is capable of expanding and contracting and thus compensating for the changes in the volume of the insulating medium 3 possibly caused by thermal expansion or changes in the external pressure. It should be especially taken into consideration in the structure of the transformer that no air pockets remain inside it, because in high pressure, which exists in a depth of 500 m at the sea bottom, for instance, air compresses, whereby high mechanical stress is exerted on the container 2. The corrugation in the container 2 should allow and endure thermal expansion and oil compression due to pressure changes depending on its gas content. During assembly, the inner container 2 is dried and filled with the insulating medium 3 in vacuum and closed hermetically. This way, the compression of oil remains minimal.

The electrical bushings of the inner container 2 of the transformer are made either by bushings or using standard bushing insulators which in the figure are marked by reference numerals 9 and 10. The connecting cables 12 of the transformer are connected to these bushing insulators 9 and 10 with special pressure-proof and water-proof cable shoes 11. In the figure, only one connecting cable and cable shoe is shown for clarity's sake, but naturally each bushing insulator 9 and 10 is connected with a corresponding connecting cable and cable shoe.

In the transformer of the invention, the in practice standard-structure transformer described above is placed inside the outer container 4. This outer container is built of acid-proof high-strength steel. This container has cable bushings 13 equipped with connectors, to which the connecting cables 12 of the transformer are connected. Further, a pipe flange 7 with a pressure equaliser 8 connected to it is connected to the container 4. The pressure equalising pipe 6 extends from the pipe flange 7 to the bottom part of the container 4 so that it opens out close to the bottom of the container 4. This way, water coming in through the pressure equaliser 8 to the pressure equalising pipe 6 during a possible leak, being heavier than oil, sinks directly down to the bottom of the outer container 4 and does not in any way weaken the insulation of the electrical bushings of the transformer. Even in later use, pressure changes cannot cause such a flow in the outer container 4 that the water leaked into the bottom of this container could pass the bushing insulators 9 and 10.

Since the active part of the transformer itself, i.e. the transformer core 1 and windings, is in a separate container 2, a leak should also occur in this container 2 before the insulation strength of the transformer would weaken. Further, the bushing insulators 9 and 10 are located on the top cover of the inner container 2 of the transformer, and since the cable shoes 11 preferably have a watertight structure, not even the filling up of the outer container 4 with water would alone cause damage and malfunctions in the transformer. Because the inner container 2 is completely encompassed by an insulating medium, such as oil, the container 2 need not be made of an acid-proof material.

The walls of the outer container 4 of the transformer should be made relatively stiff, equipped with a ribbing, for instance, to make the container 4 endure filling up in vacuum. This outer container 4, too, is filled with an insulating medium, such as oil 5, so that no air remains inside, thus when the transformer is sunk deep into water, water pressure cannot cause the air to compress, which would mechanically strain the container 4 in question.

The transformer of the invention has above been described by means of only one exemplary embodiment and it is obvious that it can be modified in many ways without departing from the scope of protection defined in the attached claims.

What is claimed is:

1. A transformer for underwater use, comprising:

a transformer core and a winding located in a first container filled wit an insulating medium, a top surface of which container is provided with pressure-proof bushings for connecting cables, a second container filled with an insulating medium, and means for equalizing pressure between the insulating medium in the second container and the transformer surroundings, wherein the second container is arranged to completely encompass the first container and the second container is equipped with pressure-proof cable bushings and associated connectors for external connections of the transformer, and wherein the means for equalizing the pressure between the insulating medium of the second container and the transformer surroundings comprises:

a pressure equalizing container; and a pressure equalizing pipe connected thereto, said pipe being led through the second container through a pressure-sealed inlet on an upper surface thereof, said pipe extending to a bottom part of the second container and having an inlet proximate thereto.

2. A transformer as claimed in claim 1, wherein the first container has a wall comprising corrugated parts to allow for volume changes caused by thermal expansion and pressure changes of the insulating medium filling the first container.

3. A transformer as claimed in claim 1, wherein the pressure-proof bushings arranged in the first container comprise bushing insulators and the associated connectors include connecting cables of the transformer connected to the bushing insulators with pressure-proof and water-proof cable shoes.

* * * * *

UNITED STATES PATENT AND TRADEMARK OFFICE

CERTIFICATE OF CORRECTION

PATENT NO. : 6,456,179 B1
DATED : September 24, 2002
INVENTOR(S) : Backa et al.

It is certified that error appears in the above-identified patent and that said Letters Patent is hereby corrected as shown below:

Title page,
Item [73], Assignee, please change "Merger Recipient ABB OY" to -- ABB Oy --.

Signed and Sealed this

Fourth Day of February, 2003

JAMES E. ROGAN
*Director of the United States Patent and Trademark Office*